US005234115A

United States Patent [19]

Lin

[11] Patent Number: 5,234,115

[45] Date of Patent: Aug. 10, 1993

[54] FIREPLACE TOOL SET STAND

[76] Inventor: Patrick Lin, 14th Fl., No. 128, Sec. 3, Min Sheng E. Rd., Taipei, Taiwan

[21] Appl. No.: 994,340

[22] Filed: Dec. 21, 1992

[51] Int. Cl.[5] ..... A47B 43/00

[52] U.S. Cl. ..... 211/196; 248/165; 126/500

[58] Field of Search ..... 126/500; 211/196; 248/165

[56] References Cited

U.S. PATENT DOCUMENTS

| | | | |
|---|---|---|---|
| 1,243,173 | 10/1917 | Hinckley | 211/196 |
| 2,650,717 | 9/1953 | Larson | 211/196 |
| 3,955,787 | 5/1976 | Brown | 211/196 |

*Primary Examiner*—Carroll B. Dority

*Attorney, Agent, or Firm*—Parkhurst, Wendel & Rossi

[57] ABSTRACT

A fireplace tool set stand includes a lower part and an upper part detachably mounted to the lower part. The lower part includes a bar with a threaded upper end and four legs extending from a lower end thereof. The upper part includes a plurality of hooks each having a downward hooked portion for hanging a fire iron thereon. The hooks are welded together at their common bottom end, with a flange formed at a periphery of the bottom end. A fastener is provided to the bottom end, with internal threadings formed in an inner periphery thereof for engaging with the threaded upper end of the bar. The fastener is retained on the upper part by the flange. Preferably, the legs of the lower part are foldable or detachable to provide a more compact volume.

1 Claim, 2 Drawing Sheets

FIREPLACE TOOL SET STAND

BACKGROUND OF THE INVENTION

The present invention relates to a fireplace tool set stand and, more particularly, to a fireplace tool set stand which can be disassembled for transportation.

A fireplace tool set stand on which a poker, shovel, tongs and broom are hung is a requisite for a fireplace. The bulky volume of the wrought-iron-made fireplace tool set stand, however, has always been a trouble in transportation. A wrought-iron-made fireplace tool set stand with a foldable base part has been proposed. Yet the total length and outlook of such a fireplace tool set stand remains unchanged.

Therefore, there has been a long and unfulfilled need for a fireplace tool set stand which is easy to disassemble to mitigate and/or obviate the above-mentioned drawbacks.

SUMMARY OF THE INVENTION

A fireplace tool set stand in accordance with the present invention includes a lower part and an upper part detachably mounted to the lower part. The lower part includes a bar with a threaded upper end and four legs extending from a lower end thereof. The upper part includes a plurality of hooks each having a downward hooked portion for hanging a fire iron thereon. The hooks are welded together at their common bottom end, with a flange formed at a periphery of the bottom end. A fastener is provided to the bottom end, with internal threadings formed in an inner periphery thereof for engaging with the- threaded upper end of the bar. The fastener is retained on the upper part by the flange. Preferably, the legs of the lower part are foldable or detachable to provide a more compact volume.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
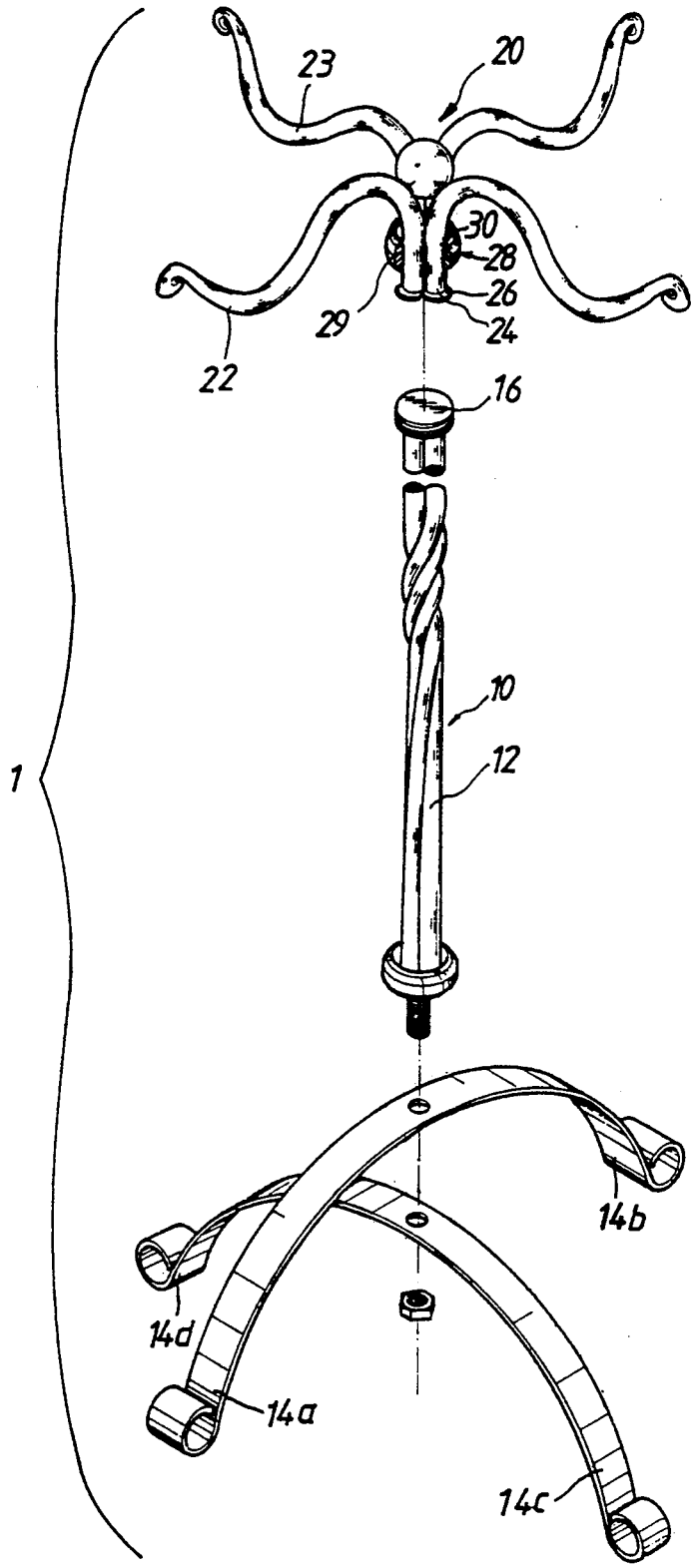
FIG. 1 is an exploded view of a fireplace tool set stand in accordance with the present invention.
Figure 2:
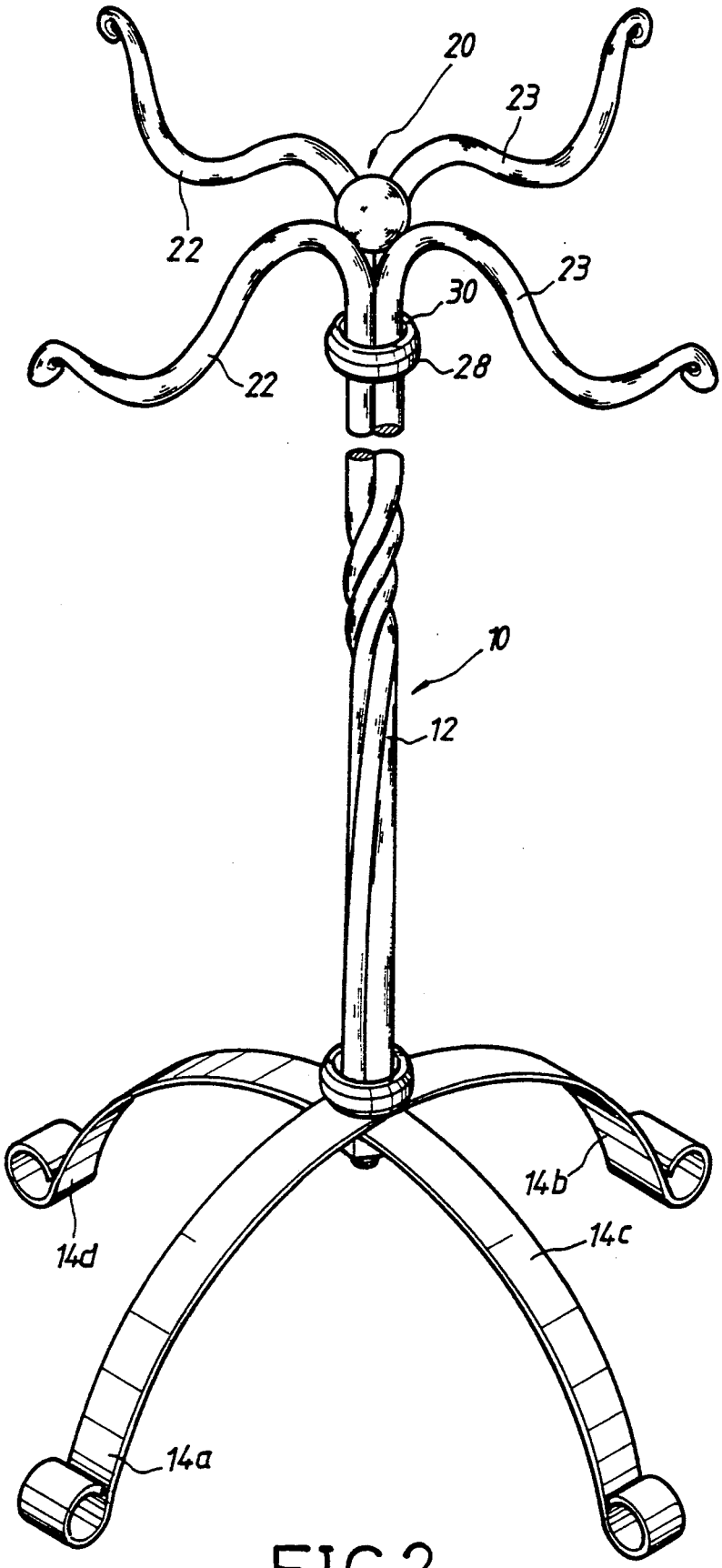
FIG. 2 is a perspective view, partly in section, of the fireplace tool set stand of the present invention.

Referring to FIGS. 1 and 2, a fireplace tool set stand 1 in accordance with the present invention generally includes a lower part 10 and an upper part 20 detachably mounted to the lower part 10. The lower part 10 generally consists of a bar 12 with an threaded upper end 16 and four legs 14*a*, 14*b*, 14*c*, and 14*d* extending from a lower end thereof. The fireplace tool set stand is preferably made of wrought iron.

Still referring to FIG. 1, the upper part 20 is substantially four hooks 22 for hanging a poker, shovel, tongs, and broom (not shown) on a downward hooked portion 23 thereof. The hooks 22 are welded together at their common bottom end 24, with a flange 26 formed at a periphery of the bottom end 24. A fastener 28 is provided to the bottom end 24, with internal threadings 29 formed in an inner periphery thereof for engaging with the threaded upper end 16 of the bar 12. It is appreciated that an end 30 of the fastener 28, which is distal from the engaging end, is stopped by the flange 26, thereby preventing the fastener 28 from being inadvertently lost.

Preferably, the legs 14*a*–14*d* of the lower part 10 are rotatable to provide a more compact volume. This can be easily achieved by casting the four legs in pairs, i.e., legs 14*a* and 14*b*; 14*c* and 14*d* are integrally formed, and that one pair of legs 14*c* and 14*d* is rotatable through 90 degrees to a position proximate to the other pair of legs 14*a* and 14*b*. Alternatively, the legs 14*a*–14*d* may be mounted to the bar by screw connection and thus can be easily detached therefrom, as clearly shown in FIG. 1.

Although the invention has been explained in relation to its preferred embodiment, it is to be understood that many other possible modifications and variations can be made without departing from the spirit and scope of the invention as hereinafter claimed.

I claim:

1. A fireplace tool set stand comprising a lower part and an upper part detachably mounted to said lower part, said lower part comprising a bar with a threaded upper end and four legs extending from a lower end thereof, said upper part comprising a plurality of hooks each having a downward hooked portion for hanging a fire iron thereon, said hooks being welded together at their common bottom end, with a flange formed at a periphery of said bottom end, a fastener being provided to said bottom end, with internal threadings formed in an inner periphery thereof for engaging with said threaded upper end of said bar, said fastener being retained on said upper part by said flange.

* * * * *